US011154741B2

(12) United States Patent
Özgün

(10) Patent No.: US 11,154,741 B2
(45) Date of Patent: Oct. 26, 2021

(54) FITNESS APPARATUS FOR PRESS-UP EXERCISES

(71) Applicant: Metin Özgün, Nuremberg (DE)

(72) Inventor: Metin Özgün, Nuremberg (DE)

( * ) Notice: Subject to any disclaimer, the term of this patent is extended or adjusted under 35 U.S.C. 154(b) by 110 days.

(21) Appl. No.: 16/608,765

(22) PCT Filed: Apr. 25, 2018

(86) PCT No.: PCT/EP2018/060614
§ 371 (c)(1),
(2) Date: Oct. 25, 2019

(87) PCT Pub. No.: WO2018/206292
PCT Pub. Date: Nov. 15, 2018

(65) Prior Publication Data

US 2021/0001163 A1 Jan. 7, 2021

(30) Foreign Application Priority Data

May 9, 2017 (DE) ..... 102017109982.4

(51) Int. Cl.
*A63B 21/00* (2006.01)
*A63B 21/062* (2006.01)
(Continued)

(52) U.S. Cl.
CPC .... *A63B 21/00181* (2013.01); *A63B 21/0087* (2013.01); *A63B 21/068* (2013.01); *A63B 21/0628* (2015.10); *A63B 21/151* (2013.01); *A63B 21/4031* (2015.10); *A63B 21/4035* (2015.10); *A63B 21/4047* (2015.10); *A63B 23/03516* (2013.01); *A63B 23/1236* (2013.01); *A63B 71/0622* (2013.01)

(58) Field of Classification Search
CPC ..... A63B 21/00181; A63B 21/0628; A63B 21/4031; A63B 21/4035; A63B 21/4047; A63B 21/0087; A63B 21/068; A63B 21/151; A63B 23/03516; A63B 23/1236; A63B 71/0622; A63B 2071/065; A63B 2210/50; A63B 2208/0257; A63B 23/03525
See application file for complete search history.

(56) References Cited

U.S. PATENT DOCUMENTS 4,195,834 A * 4/1980 Lambert, Jr. ..... A63B 21/06 482/101
5,106,079 A * 4/1992 Escobedo ..... A63B 21/0615 482/137

(Continued)

FOREIGN PATENT DOCUMENTS

DE 102014011904 A1 2/2016

*Primary Examiner* — Andrew S Lo
(74) *Attorney, Agent, or Firm* — Rimôn, P.C.

(57) ABSTRACT

Fitness equipment (1), in particular for the assisted performance of press-ups, comprising a support device (2) having a movable support (3) on which a user rests during use, and an assistance device (4) that is configured for generating an assistance force that moves the support (3) into an initial position, wherein the assistance device (4) is or comprises a traction device which is configured to generate an assistance force on the support (3) that moves the support (3) into the initial position and acts as a tensile force.

11 Claims, 3 Drawing Sheets

(51) Int. Cl.

| | |
|---|---|
| ***A63B 21/008*** | (2006.01) |
| ***A63B 21/068*** | (2006.01) |
| ***A63B 23/12*** | (2006.01) |
| ***A63B 23/035*** | (2006.01) |
| ***A63B 71/06*** | (2006.01) |

(56) References Cited

U.S. PATENT DOCUMENTS 5,354,251 A 10/1994 Sleamaker
5,518,487 A * 5/1996 Hallmark ..... A63B 23/0211 482/140
5,752,879 A * 5/1998 Berdut ..... A63B 21/068 482/142
5,928,116 A * 7/1999 Chiang ..... A63B 23/03525 482/72
7,060,014 B2 * 6/2006 Bergman ..... A63B 21/00181 482/141
7,658,702 B1 * 2/2010 Harms ..... A63B 21/4029 482/141
7,731,638 B2 * 6/2010 Webber ..... A63B 23/03541 482/72
7,927,262 B2 * 4/2011 Clark ..... A63B 23/0355 482/103
7,976,442 B2 * 7/2011 Quinn ..... A63B 23/0355 482/100
8,721,509 B1 * 5/2014 Berdut-Teruel ..... A63B 21/00069 482/121
9,486,668 B2 * 11/2016 Williams ..... A63B 21/00065
2004/0097352 A1 * 5/2004 Bergman ..... A63B 21/00181 482/141
2005/0032614 A1 * 2/2005 Keiser ..... A63B 21/4029 482/142
2008/0045390 A1 * 2/2008 Harms ..... A63B 23/12 482/141
2010/0022362 A1 * 1/2010 Macdonald ..... A63B 21/0615 482/94
2010/0087295 A1 * 4/2010 Crawley, IV ..... A63B 21/4035 482/52
2011/0275499 A1 * 11/2011 Eschenbach ..... A63B 21/00181 482/141
2013/0203568 A1 8/2013 Kastro
2014/0274620 A1 * 9/2014 Hoole ..... A63B 21/0421 482/141
2015/0297948 A1 10/2015 Meister et al.
2016/0213971 A1 * 7/2016 Jones ..... A63B 22/0069
2016/0236062 A1 8/2016 Wang
2017/0157452 A1 * 6/2017 Lagree ..... A63B 22/0089
2019/0374814 A1 * 12/2019 KashKash ..... A63B 22/0089

* cited by examiner

FITNESS APPARATUS FOR PRESS-UP EXERCISES

The invention relates to fitness equipment, in particular for the assisted performance of press-ups, comprising a support device having a movable support on which a user rests during use, and an assistance device that is configured for generating an assistance force that moves the support into an initial position.

In the fitness industry, in particular in the field of strength training for muscle building, a plurality of exercises and variants are known by means of which it is possible to train individual muscle groups. Furthermore, it is known in this case that, for the purpose of adjustment to different users or different fitness levels, a resistance against which an exercise is performed, for example by means of moving a weight, is preferably variable, in order that a defined number of repetitions of the same exercise can be performed. For example, it is therefore known, when performing body weight exercises, for example in the case of pull-ups or press-ups, to provide an assistance device that is configured to generate an assistance force that assists the user when performing the corresponding exercise.

For example, DE 10 2014 011 904 A1 or U.S. Pat. No. 7,060,014 B2 disclose fitness equipment that allows for assisted performance of press-ups. In this case, a support of a support device is braced by a spring element, such that, when performing press-ups, a user resting on the support only has to move a force generated by their body weight or their body mass, minus the spring force. However, a disadvantage in this case is the fact that the installed spring element exerts a pressing force and always has the same spring characteristics or spring hardness, and the fitness equipment is therefore not designed for different users, in particular users of different weights or users of different fitness levels. It is likewise not possible to adjust the assistance force in order for it to be possible to perform a defined number of repetitions.

A further problem is the fact that the spring element does not generate a constant assistance force on the support, but rather a spring force that is dependent on the spring characteristics and on the deflection from the initial state, i.e. a compressive force, with the result that the force to be applied by the user is assisted too greatly, in relative terms, in particular in the region of the maximum deflection, i.e. when the spring element is at its most compressed.

The object of the invention is therefore that of specifying fitness equipment in which the assistance of the performance is improved.

The object is achieved by fitness equipment of the type mentioned at the outset, having the features of claim 1.

Therefore, according to the invention, the assistance device is or comprises a traction device which is configured to generate an assistance force on the support that moves the support into the initial position and acts as a tensile force. The assistance device is therefore not configured as a spring element that pushes the support into the initial position, as is convention in the prior art, but rather the assistance device according to the invention is configured as or comprises a traction device. In order to assist the performance of the exercise, in particular of press-ups, the support is pulled, by the assistance device, counter to the movement performed during the exercise, such that the user does not train with their entire body weight when using the equipment. The user moves only a reduced total weight during the exercise, which weight is made up of the fraction resulting from their body weight, minus the tensile force applied by the assistance device. The constant tensile force means that, according to the invention, the disadvantage of the assistance being dependent on the deflection out of the initial state is overcome. According to the invention, the generated assistance force remains approximately constant over the entire course of the movement.

As a result, according to the invention, people or users who cannot perform any press-ups or who cannot perform a specified number of press-ups, or who can perform them only badly, are assisted by the assistance device such that the effective total weight, i.e. the resistance, is reduced. As a result, users having corresponding physical impairments or fitness levels can also be made able to perform the corresponding exercise in the corresponding range of repetitions, because the preferably adjustable assistance force can be selected accordingly, in particular in a user-dependent manner. It is thus possible to ensure that the individual user can select the total weight, and ultimately the resistance, when training, such that the number of repetitions is in a desired range (maximum force, hypertrophy, strength endurance, etc.).

In the case of the fitness equipment according to the invention, it is preferable for the support to be pivotably mounted on the support device, at a first portion, and to be coupled to the assistance device, at a second portion. In this case, the support is preferably positioned so as to be slanted in space or so as to be slanted with respect to the substrate, wherein the slant can of course be set in the initial position. At a first portion, the support device is mounted so as to be pivotable relative to the support device, so as to be able to pivot relative to the support device during use, which support device is configured for example in the manner of a training bench. In this case, the support is preferably pivotably connected to the support device by means of a bolt or the like, where in the bolt or the bearing of the support specifies the axis of rotation or the pivot axis of the support.

In this case, it is particularly preferable for the first and the second portion to in each case be arranged on an end region of the support. The support is therefore mounted on the support device by a first end or by the first portion that is located on an end region of the support. The support is therefore pivotable, relative to the support device, about an axis of rotation located on the first end region of the support. At the opposite end or the support or the other end region of the support, the support is coupled to the assistance device. For example, for this purpose, a corresponding receptacle for a fastening means, for example a hook for a traction element of the assistance device, may be provided, such that the assistance device can be coupled to the second portion, at the corresponding end region of the support. In this case, the coupling between the assistance device and the support device is preferably configured so as to be completely releasable, such that the support device is separable from the assistance device.

This results, advantageously, in the support device being able to be transported or, when not in use, stored, separately from the assistance device. This furthermore makes it possible for the assistance device and the support device to form independent modules that can also be combined, separately from one another, with other devices, in particular other fitness equipment or parts thereof.

In a preferred embodiment of the fitness equipment according to the invention, it may be possible for the assistance device to comprise a deflection means that deflects a traction element, and at least one assistance mass, in particular of a variable mass, wherein the traction element couples the support to the assistance mass. According to this embodiment, the assistance device comprises at least one assistance mass that is connected to the support via a traction element. In this case, the traction element extends from the assistance mass, via the at least one deflecting deflection means, to the second portion of the support, at which said support is coupled to the assistance device. In other words, during use of the fitness equipment, when the support is moved towards the base, owing to the user's body weight, the at least one assistance mass is pulled upwards by the traction element or the deflection means. In the same way, the assistance device brings about a reduction in the force to be applied by the user, since the traction element pulls (upwards) on the support, owing to the coupling to the assistance mass, with the result that the user is assisted when performing the press-ups.

In this case, the assistance mass may comprise a plurality of assistance mass elements or may be variable in mass itself. This advantageously allows for the user to select the assistance mass, such that said mass can be adjusted to the fitness level and/or the body weight and/or the training range or the number of repetitions. The traction element is preferably formed as a cable or as a rope or as a belt, wherein the embodiment of the traction element as a belt is preferred.

According to a further preferred embodiment of the fitness equipment according to the invention, at least one gripping device may be provided, which device is preferably arranged on the support device and comprises at least one gripping region at which a user grips the gripping device during an exercise. During use of the fitness equipment, the user thus rests with their front on the support and grips the gripping device in the at least one gripping region. In this case, the gripping device or the at least one gripping region is arranged such that the user reaches said device or region from the initial position. For this purpose, it is possible in particular for the inclination of the support in the initial position, or the relative position between the gripping device and the support device, in particular a height of the gripping device or of the gripping region, to be adjustable. It is thus possible to position the gripping device or the at least one gripping region relative to the support.

The gripping device particularly preferably comprises at least two gripping regions, the mutual spacing of which is adjustable. The two gripping regions are therefore arranged, in particular on the support device, such that the mutual relative spacing thereof is adjustable. As a result, the user can advantageously set their gripping width or their hand spacing during use. As a result, the fitness equipment can also be adjusted to different user or different exercises, in particular press-ups having different hand positions or gripping widths. In this case, it may furthermore be possible for the at least two gripping regions to be able to be positioned relative to the support device or the support of the fitness equipment in a mutually independent manner. As a result, exercises having hand positions that are offset in the longitudinal direction, and the like, are also possible.

The fitness equipment according to the invention can furthermore be developed such that the gripping device preferably comprises at least two groups of gripping regions, wherein the individual groups of gripping regions are arranged so as to be at different angles to a longitudinal axis of the support device, or such that at least two gripping regions are provided, the angles of which relative to the longitudinal axis of the support device can be adjusted. According to the first alternative of this embodiment, at least two groups of gripping regions are provided. The individual groups of gripping regions differ in terms of their arrangement, in particular in the angle that the individual gripping regions of the individual groups of gripping regions assume, relative to the longitudinal axis of the support device. As a result, a plurality of gripping variants or gripping angles can be provided, wherein for example one group comprises gripping regions arranged perpendicularly to the longitudinal axis of the support device, and a further group comprises gripping regions that are arranged so as to be inclined thereto, for example at an angle of from 45° to 75°, particularly preferably 55° to 65°, in particular 60°. An arrangement of the gripping regions that is inclined relative to the vertical, in particular in the above-mentioned angular range, has been found to be better adjusted to the course of movement and/or the human anatomy than an arrangement purely perpendicular to the longitudinal axis. An ergonomic arrangement of the gripping regions is thus ensured.

According to a second alternative of the embodiment described above, at least two gripping regions are preferably provided, the angles of which relative to the longitudinal axis of the support device are adjustable. Accordingly, the orientation of the two gripping regions can be adjusted, in particular in a mutually independent manner. Accordingly, it is possible to specify the angle at which the gripping regions are arranged relative to the longitudinal axis of the support device. In this case, the gripping regions are particularly preferably adjustable between a perpendicular and a parallel arrangement, with respect to the longitudinal axis of the support device, wherein an adjustment into all intermediate positions, in specified steps or continuously, is of course also possible.

A preferred development of the fitness equipment according to the invention can consist in a base part being assigned to the support device, which base part can be positioned in at least two base part positions, relative to the support, for adjustment to a body size of a user. The base part is provided in order that the user can assume a defined position on the support, in which the user's feet stand on the base part while said user rests on the support. Alternatively to the positioning of the gripping regions, or in addition thereto, the base part can be positioned, relative to the support, in at least two or in a plurality of base part positions. As a result, the fitness equipment can be adjusted to the user's body size, because the base part can be positioned along the support depending on the user's body size. This ultimately specifies the way in which the user rests on the support, relative to the fitness equipment, or at which position the user rests thereon, in order to ensure an optimal gripping angle, i.e. a progression of the arms, when performing the exercise or using the fitness equipment. Of course, the base part can also be varied depending on the exercise performed on the fitness equipment, such that a change in the angle of the arms relative to the user's body axis can be selected in a purposeful manner.

According to a further preferred embodiment of the invention, the fitness equipment is assigned at least one damping means, in particular a pneumatic cylinder, which is provided for damping a movement of the support. As a result of the damping means, movements of the support are damped, such that the support does not perform any movements uncomfortable for the user, or components of this kind are reduced, during use. In addition, the noise generation during use is improved. The damping means furthermore preferably brings about stabilisation of the support. For example, in this case the damping means can be formed purely mechanically, in particular by means of two tubes that are arranged coaxially and are guided inside one another. During movement of the support, the two tubes are displaced relative to one another, but bring about assistance of the forces acting on the support that deviate from the tube longitudinal axis, such that the support is stabilised.

Furthermore, it may preferably be possible, in the fitness equipment according to the invention, that the support or the support device comprises a face opening and/or a face recess. An opening or recess of this kind, that is located in the region of the support that is allocated to the user's face, allows said user to not have to train having their face to the support or to a part of the support device, but instead to maintain a free view through the support or the support device. This improves the comfort for the user, because breathing is facilitated, in particular in the case of intensive training, and the approval of the fitness equipment among users is improved owing to the lack of contact between the face and the support or a part of the support device.

According to a further preferred embodiment of the fitness equipment according to the invention, the support device and/or the assistance device may comprise at least one transport means that is particularly preferably configured as a roller. The transport means allows for easier transportation of the support device or the assistance device. For this purpose, it may be possible, for example, to tilt the support device and/or the assistance device on the transport means, for example the roller, in order to be able to subsequently move said device(s) more easily. Of course, all other transport means and the safety devices thereof, for example brakes and the like, can be provided.

Furthermore, at least one safety means is preferably provided in the fitness equipment according to the invention, which safety means is configured to prevent unauthorised access, in particular to movable parts, and/or incorrect operation of the fitness equipment. The safety means in particular ensures a standard that is necessary or has to be met for a classification of the fitness equipment. The safety means avoids or prevents a user or a bystander from operating the fitness equipment incorrectly and/or from achieving unauthorised access to components of the fitness equipment. In this case, preferably in particular the movable parts of the fitness equipment are shielded or covered such that the user and/or a bystander cannot encroach into a hazardous region formed by the movable parts. Furthermore, incorrect operation is prevented in that the fitness equipment can be left only in a secured state, so as to prevent the at least one assistance mass falling off. For this purpose, it is possible for example for a corresponding safety mechanism to be provided which allows for securing and/or safe return of the assistance mass if the user is in a position deflected out of the initial position and cannot perform any further press-ups.

According to a further preferred embodiment of the invention, a display device is provided which is configured to display at least one item of exercise-specific and/or user-specific information. Accordingly, various information can be displayed on the at least one display device, for example which exercise is performed on the fitness equipment and/or a number of repetitions and/or a number of sets that has currently been achieved and/or is still to be performed. Furthermore, information relating to the user can be displaced, for example the fitness information of said user, such as a heart rate and/or a training exposure.

In addition, the invention relates to a support device for fitness equipment according to the invention. Of course, all the advantages, details and features described above in relation to the fitness equipment can be transferred to the support device according to the invention. In particular, the support device according to the invention allows for modular coupling or decoupling to or from an assistance device that is already present, for example a weights tower comprising a corresponding Bowden cable. As a result, the support device can be used in a modular manner and can be integrated into an existing gym or exercise studio.

The invention will be explained in greater detail in the following, on the basis of embodiments and with reference to the drawings. The drawings are schematic views, in which.

Figure 1:
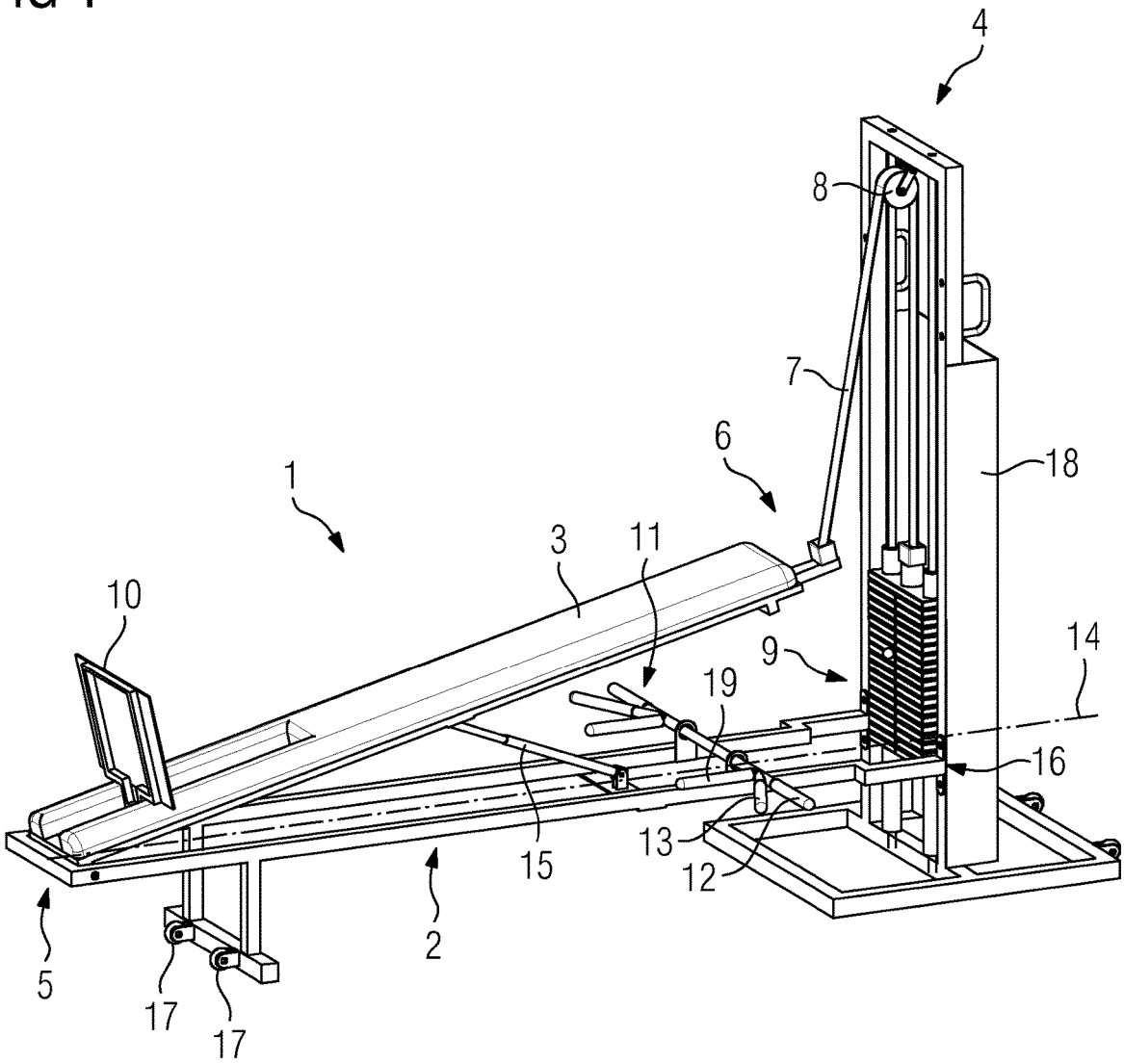
FIG. 1 is a perspective view of fitness equipment according to the invention.

FIG. 1 shows fitness equipment 1 for the assisted performance of press-ups. The fitness equipment 1 comprises a support device 2 having a movable support 3, on which a user rests when using said equipment. The fitness equipment 1 further comprises an assistance device 4 which is configured to generate an assistance force that moves the support 3 into an initial position (cf. FIGS. 1-3). It is clear that the assistance device 4 is configured as a traction device, wherein the assistance force generated by the assistance device 4 acts on the support 3 as a tensile force. It is clear that the support 3 is coupled to the support device 2 in a first portion 5, for example so as to be pivotable, by means of a bolt. On the end of the support 3 opposite the first portion 5 said support comprises a second portion 6, at which the support 3 is coupled to the assistance device 4. The assistance device 4 additionally comprises a traction element 7 that is configured for example as a rope or a cable or a belt. The traction element 7 extends from the second portion 6 of the support 3, via a deflection means 8, to an assistance mass 9 of the assistance device 4.

The assistance mass 9 additionally comprises a plurality of assistance mass elements. In this case, a corresponding pin is used to select how many of the individual assistance mass elements are raised, and thus how many form the effective, moved assistance mass 9.

The fitness equipment 1 further comprises a base part 10 that is arranged so as to be displaceable relative to the support 3, and can thus be positioned, in particular in a stepless manner, in a plurality of positions along the support 3. It is clear that the positioning of the base part 10 of the fitness equipment 1 can be adjusted to a body size of a user. In particular, the positioning of the base part 10 can be matched to a gripping device 11.

In this embodiment the gripping device 11 is arranged on the support device 2. The gripping device 11 comprises a first group of gripping regions 12 and a second group of gripping regions 13. Each of the two groups of gripping regions 12, 13 comprises two gripping regions, respectively, wherein the gripping regions of the first group of gripping regions 12 are arranged so as to be substantially perpendicular to a longitudinal axis 14 of the fitness equipment 1 or of the support device 2, and the gripping regions of the second group of gripping regions 13 are arranged so as to be at an angle, for example of between 40° and 60°, relative to the longitudinal axis 14. The mutual spacings of the individual gripping regions can be adjusted as desired. The gripping device 11 is therefore extensible, for example telescopically, in the longitudinal direction thereof. According to this embodiment, the gripping device 11 further comprises a third group of gripping regions 19 which are oriented so as to be substantially in parallel with the longitudinal axis 14. Of course, it is alternatively also possible for one single group of gripping regions or at least two gripping regions to be provided, the angle of which relative to the longitudinal axis 14 can be adjusted as desired.

A damping element 15 is furthermore provided between the support 3 and the support device 2, which damping element damps the movements of the support 3 relative to the support device 2. Furthermore, the damping element 15 brings about stabilisation of the support 3 relative to the support device 2. The damping element 15 is for example configured as a pneumatic cylinder. The damping element 15 improves the movement or the course of movement of the support 3, in particular when the user rests on or gets off the support 3.

The support device 2 and/or the assistance device 4 are releasably interconnected in a coupling region 16. As a result, the support device 2 can be released from the assistance device 4 in order to be used in a modular manner on another assistance device 4 or in order for the assistance device 4 to be used for other training exercises or in combination with other fitness equipment.

In order to improve the transport of the assistance device 4 and/or of the support device 2, said devices comprise suitable transport means 17, for example rollers. Therefore, by way of corresponding tilting or inclination of the support device 2 or of the assistance device 4, in the released state, said devices can be transported in a simplified manner. In this case, it may in particular be possible for the support 3 to be lockable in a position deflected out of the initial position.

The assistance device 4 further comprises a safety means 18 which prevents unauthorised access to the assistance mass elements of the assistance mass 9. As a result, the possibility of a user or a bystander encroaching into the movable parts, in particular between two assistance mass elements of the assistance mass 9 or into to the traction element 7, can be excluded.

Figure 2:
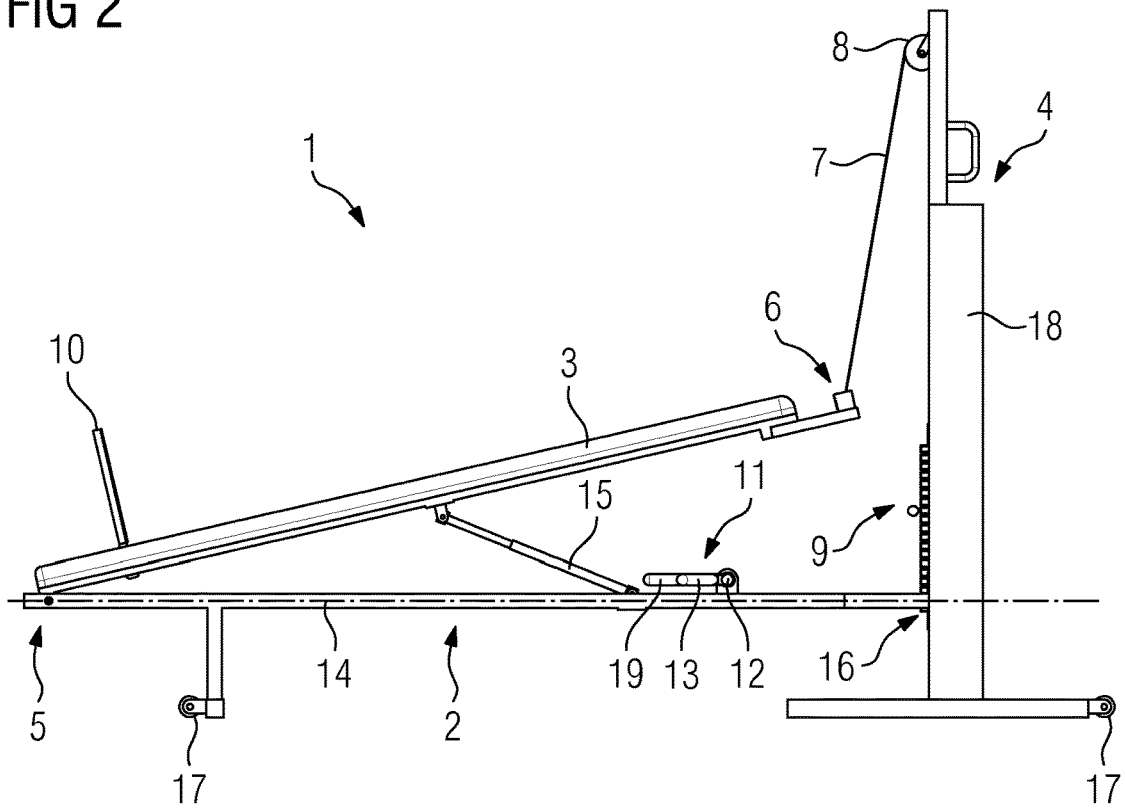
FIG. 2 is a side view of the fitness equipment according to the invention from FIG. 1.
Figure 3:
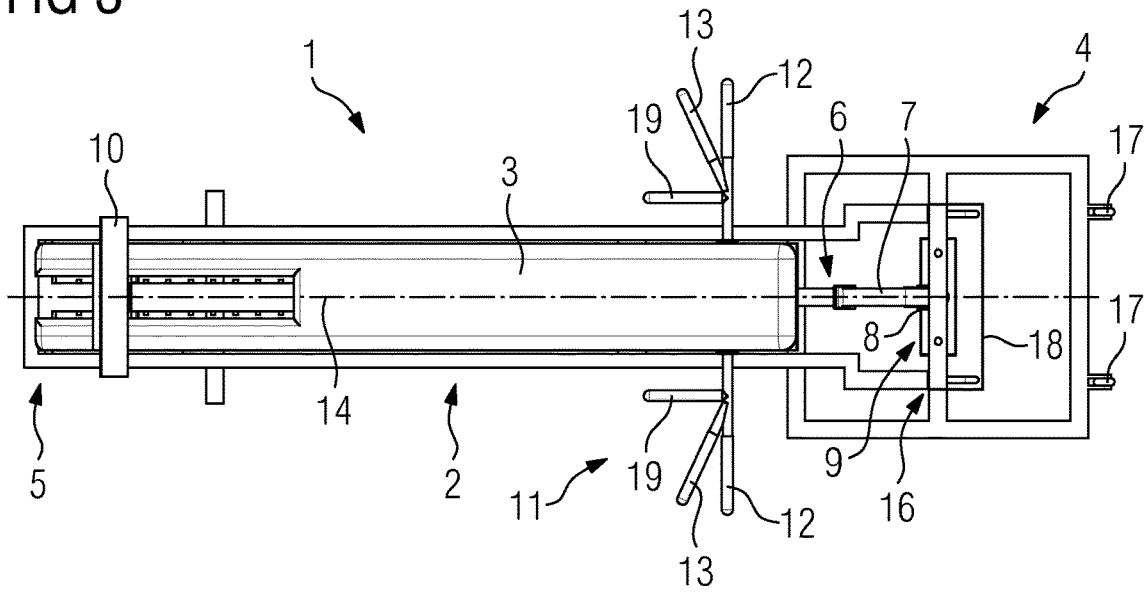
FIG. 3 is a plan view of the fitness equipment according to the invention from FIG. 1.
Figure 4:
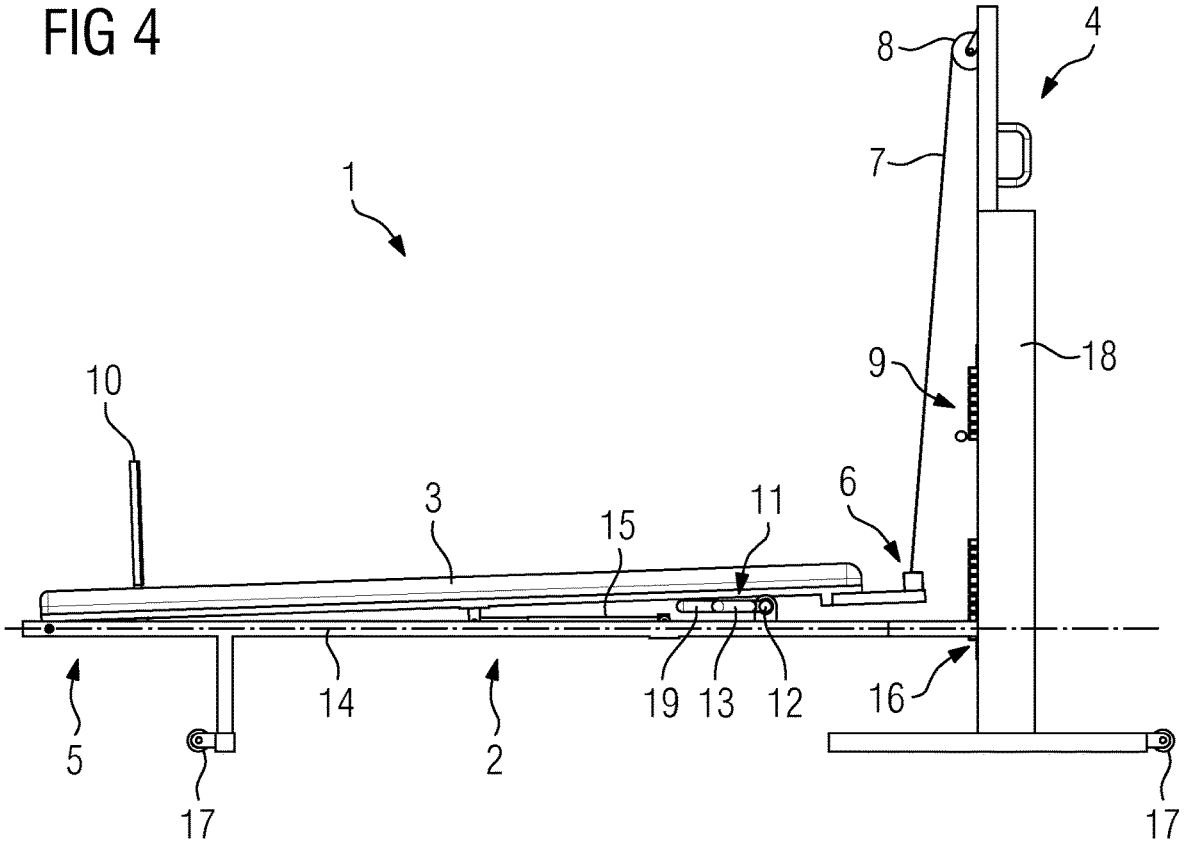
FIG. 4 shows the fitness equipment according to the invention from FIG. 1 in a position deflected out of the initial position.

FIG. 4 shows the fitness equipment 1 in a position deflected out of the initial position, as shown in FIGS. 1 and 2. The support 3 is thus in a lower position and/or the angle between the support 3 and the support device 2 has reduced during the movement.

As a result of the performance of press-ups, in which a user resting on the support 3 presses upwards, the support 3 moves between the initial position shown in FIG. 1 and the position as is shown in FIG. 4. In the case of a movement of this kind, the coupling of the support 3 to the traction element 7, and thus to the assistance device 4, moves the assistance mass 9 up and down, wherein the traction element 7 is deflected by the deflection means 8. As a result, the assistance device 4 generates an assistance force on the support 3, such that the performance of press-ups by the user requires less force. The user is thus assisted when performing the press-ups, and can therefore perform a higher number of repetitions and/or a higher number of sets and/or more different exercises than is the case without assistance. At the same time, optimal posture is ensured, because the user rests on the support 3 in a defined manner, and the development of hunch or hollow back can be prevented.

In particular by means of the assistance mass 9 that is variable with respect to mass, the user can adjust the extent to which they wish to perform press-ups in an assisted manner. In particular, the selection of the number of assistance mass elements can be made with regard to a particular training range (maximum force, hypertrophy, strength endurance, etc.), and/or a fitness level of the user, and/or a body mass of the user.

LIST OF REFERENCE SIGNS

1 fitness equipment
2 support device
3 support
4 assistance device
5 first portion
6 second portion
7 traction element
8 deflection means
9 assistance mass
10 base part
11 gripping device
12 first group of gripping regions
13 second group of gripping regions
14 longitudinal axis
15 damping element
16 coupling region
17 transport means
18 safety means
19 third group of gripping regions

The invention claimed is:

1. Fitness equipment, in particular for assisted performance of press-ups, comprising a support device having a movable support on which a user rests during use, and an assistance device that is configured for generating an assistance force that moves the movable support into an initial position, wherein the assistance device is or comprises a traction device which is configured to generate the assistance force to move the movable support into the initial position and acts as a tensile force, wherein the assistance device includes a deflection means that deflects a traction element, and at least one assistance mass, in particular of a variable mass, wherein the traction element couples the movable support to the assistance mass.

2. Fitness equipment according claim 1, wherein the movable support is pivotably mounted on the support device at a first portion, and is coupled to the assistance device at a second portion.

3. Fitness equipment according to claim 2, wherein the first and the second portion are each arranged on an end region of the movable support.

4. Fitness equipment according to claim 1, wherein at least one gripping device is arranged on the support device, which at least one gripping device comprises at least one gripping region at which a user grips the gripping device during an exercise.

5. Fitness equipment according to claim 4, wherein the gripping device comprises at least two gripping regions, having adjustable spacing.

6. Fitness equipment according to claim 4, wherein the gripping device comprises at least two groups of gripping regions, wherein the individual groups of gripping regions arranged so as to be at different angles to a longitudinal axis of the support device, or in that at least two gripping regions are provided, the angles of which relative to the longitudinal axis of the support device can be adjusted.

7. Fitness equipment according to claim 1, wherein a base part is coupled to the support device and can be positioned in at least two base part positions, relative to the moveable support, for adjustment to a body size of a user.

8. Fitness equipment according to claim 1, wherein at least one damping means, in particular a pneumatic cylinder, is provided for damping a movement of the moveable support.

9. Fitness equipment according to claim 1, wherein the support device and/or the assistance device comprises at least one transport means.

10. Fitness equipment according to claim 1, wherein at least one safety means provided and is configured to prevent unauthorised access, in particular to movable parts, and/or incorrect operation of the fitness equipment.

11. Fitness equipment according to claim 1, wherein a display device is provided and is configured to display at least one item of exercise-specific and/or user-specific information.

* * * * *